United States Patent [19]

Kapreilian et al.

[11] 4,368,659

[45] Jan. 18, 1983

[54] PIANO PEDAL ASSEMBLY

[76] Inventors: Harry C. Kapreilian, 324 Nassau Ct., Marco Island, Fla. 33937; Vincent J. Hart, 4 Smith Ave., Kingston, N.Y. 12401; Robert O. Robeson, Boiceville, N.Y. 12412

[21] Appl. No.: 118,441

[22] Filed: Feb. 4, 1980

[51] Int. Cl.[3] ..... G10C 3/26

[52] U.S. Cl. ..... 84/228; 84/251; 84/452 P; 248/74 R

[58] Field of Search ..... 84/251, 252, 452 P, 84/225-232, 353, 366, 426; 248/74 R

[56] References Cited

U.S. PATENT DOCUMENTS

| | | | |
|---|---|---|---|
| 670,150 | 3/1901 | Ellis | 84/252 X |
| 1,271,130 | 7/1918 | Brown | 84/251 |
| 3,365,994 | 1/1968 | Rutherford et al. | 84/228 |
| 3,583,271 | 6/1971 | Corwin et al. | 84/452 P |
| 4,041,829 | 8/1977 | Robeson et al. | 84/225 |

*Primary Examiner*—Lawrence R. Franklin
*Attorney, Agent, or Firm*—Joseph J. Connerton

[57] ABSTRACT

A piano pedal assembly includes a plurality of pedals attached to a support member. The support member is of unitary construction, and includes a flat surface area having depressions therein adapted to contain the pedals in the assembly. Each pedal contains a pivot pin which fits into openings on the surface area. The pedals are maintained within their respective depressions by a plurality of clips which attach to the flat surface area of said support assembly to maintain said pins within said depression.

6 Claims, 3 Drawing Figures

PIANO PEDAL ASSEMBLY

BACKGROUND OF THE INVENTION

In stringed percussion instruments such as pianos, musical tones or notes are produced by depression of individual keys on the keyboard by actuating felt covered hammers to strike steel wires associated with each key. The duration and intensity of individual tones are selectively controlled by individual pedals in a piano pedal assembly. Such assemblies generally comprise two or more foot pedals, one of which functions to sustain one or more tones, while a second pedal functions to muffle tones. The pedals are individually maintained under pressure to provide return to the normal position when the desired action has been completed. Since pianos are designed for use over extended periods of time with little or no maintenance other than occasional tuning, it is essential that pedal assemblies be adapted for extended life characteristics while providing substantially noise-free and trouble-free operation. While the pedal assembly represents only one of the components of a piano, its operation is critical to the overall piano action. Finally, there is a continued emphasis on lower cost assemblies to maintain a competitive position in the piano keyboard technology.

As more fully described hereinafter, conventional piano pedal assemblies, while varying in degree of complexity, remain relatively complex and expensive to fabricate and install. In one example shown in U.S. Pat. No. 4,041,829 to Vincent J. Hart and Robert I. Robeson and assigned to the assignee of the present invention, the assembly includes a metal base plate having openings into which pedal mounting blocks are secured. Each pedal mounting block is made of a self lubricating material such as Nylon or Teflon, and has a cylindrical opening through its center for securing opposite sides of the pedal pivot pin, a pair of mounting block functioning to control the position of an associated pedal. The pedal mounting blocks function to provide and maintain controlled and precise registration of the individual pedals to which they are attached.

While the above described piano pedal assembly constituted a significant advance over prior art piano pedal assemblies, it still represented a relatively complex and costly structure in both component and assembly costs. For a conventional three pedal assembly, for example, a metallic base plate with six precisely positioned machined openings, six Teflon or Nylon bearing blocks, a screw to attach each block in position, and placement of individual pedal pivot pins within each blocks were required. The fabrication cost of components such as a one piece metallic base plate with precision machined openings therein is relatively high, as is the cost of mounting components on the base plate, and the cost of the building blocks. Further, the substitution of lower cost materials such as plastic for the base plate was not feasible, since a plastic plate would not be sufficiently rigid to maintain the bearing block assemblies in position, and would require molding of threaded openings in the base plate to maintain the pedal blocks in position on the base plate.

SUMMARY OF THE INVENTION

In accordance with the present invention, there is provided an improved piano pedal assembly which utilizes a smaller number of less complex parts fabricated from a low cost plastic material which provides accurate registration and alignment of the pedal assemblies at substantially lower cost. The invention utilizes a partially hollow plastic support assembly which is molded in a configuration designed to position and support the pedals within the assembly. The upper surface of the support assembly has elevated or raised portions for supporting the pedals and recessed portions for mounting the pedals. The raised portions, positioned on opposite sides of each pedals, have semi-circular depressions or grooves therein to accommodate the pedal pivot pins which may include plastic bushings. Individual plastic clips are provided to snap onto the elevated portions when the pedals and associated pivot pins are in position. For a three pedal assembly, four elevated portions and three recessed portions are required. Since the raised end portions of the assembly control only one pivot pin as compared to the two pins controlled by the inner raised portion, the end portions can be substantially smaller. The outer clips snap on opposite edges of the upper support assembly as compared to the inner clips for added stability. The individual clips have openings therein positioned for alignment with corresponding openings in the support assembly and used for attaching the pedal assembly to the piano. The instant invention comprises an improved piano pedal assembly having a substantially fewer number of less complex parts made of lower cost material and assembly techniques than prior art assemblies, thereby providing substantial cost savings both in material and assembly time.

Accordingly, a primary object of the present invention is to provide an improved piano pedal assembly.

Another object of the present invention is to provide a low cost piano pedal assembly comprising a molded support assembly adapted to provide registration of the pedals together with a plurality of clip members adapted to provide and maintain registration of the pedals within the assembly.

DETAILED DESCRIPTION OF PREFERRED EMBODIMENT

Figure 1:
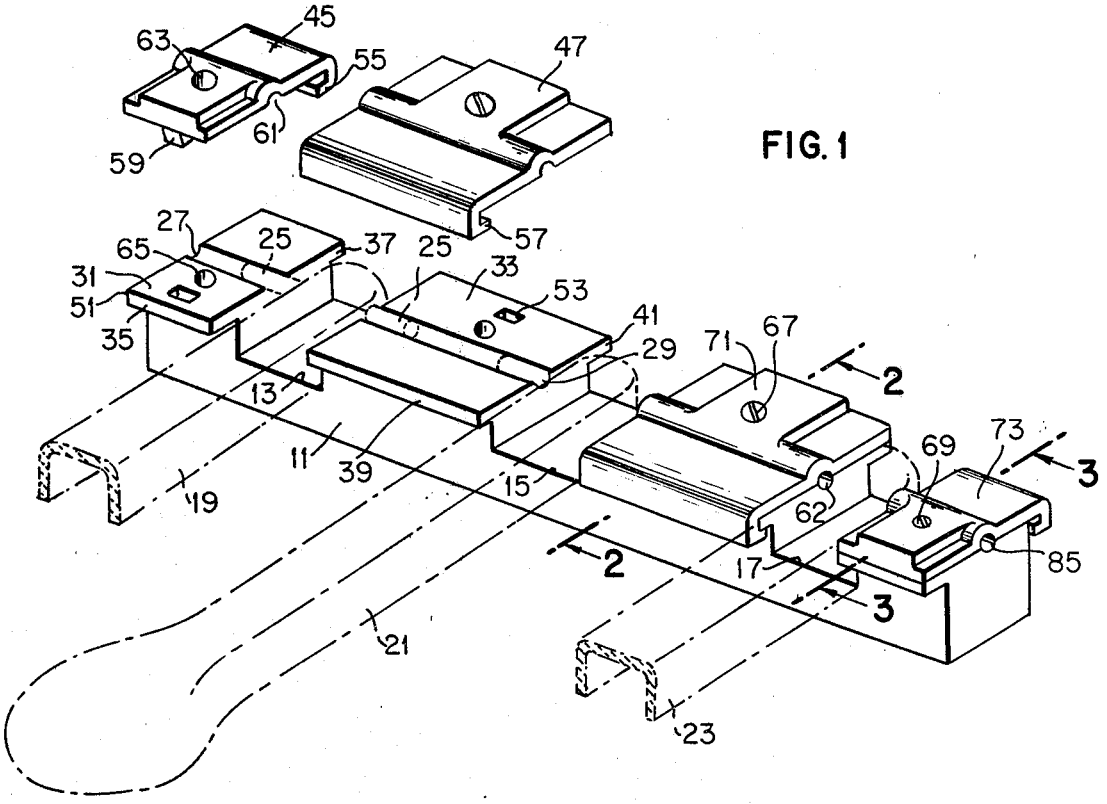
FIG. 1 is an exploded perspective view of a preferred embodiment of the present invention.

Referring now to the drawings and more particularly to FIG. 1 thereof, there is illustrated a perspective view of a preferred embodiment of the instant invention, certain parts being broken away to clarify specific details of the assembly. The assembly comprises a support assembly 11 composed of a molded plastic member having recessed portions 13, 15, 17 for containing pedal members 19, 21, 23 respectively. For purposes of this invention, the pedal members 19, 21, 23 are deemed conventional and generally made of sand or die cast brass or brass plating. For purposes of clarity, pedal member 21 is shown in detail, but pedal members 19 and 23, shown broken away, are identical. The actuatable end of the individual pedal members may take any conventional configuration such as rectangular, rounded, or any other configuration.

Each pedal member has an associated pin designated the pivot pin extending through said sides of the pedal such as pin 25 associated with pedal 19 about which the pedal pivots during operation. The support assembly has semicircular depressions formed in each of the raised portions thereof, each depression adapted to contain the associated pivot pins. In the FIG. 1 embodiment, for example, exposed openings 27, 29 are adapted to contain pivot pin 25 associated with pedal member 19. While a single metallic pin would be preferred for ease of construction, the pins would contain a plastic bushing to eliminate or reduce noise such as squeaks occurring during pedal operation. Similar pivot pin connections are employed to provide registration and alignment of pedals 21 and 23.

Once aligned, the remaining basic objective of the pedal assembly is to maintain registration of the individual pedals within the assembly. The pedals must be precisely mounted to specified tolerances, and lateral motion must be held to a minimum. Toward this end and in accordance with the preferred embodiment of the instant invention, individual plastic clip members are designed to fit the raised portions of the support assembly such as areas 31, 33 on the left portion of FIG. 1. The assembly in FIG. 1 contains four raised areas. It will be noted that each raised surface area, in addition to being elevated with respect to the recessed areas, have front and rear protruding edges on the horizontal plane. Thus, end raised area 31 has front and rear edges 35, 37 while raised area 33 has front and rear edges 39, 41 respectively. As previously noted, since the end raised areas are only required to support the pivot pins of one pedal, they are substantially shorter than members 33, 33′ which support the pivot pins of two pedals. Accordingly, two end and two inner clip members are used to provide registration of three pedals within the assembly of the FIG. 1 embodiment.

Each clip member is designed to be firmly attached to the associated raised surface portion of the support block 11 and provide the upper support for the pivot pin. Each raised portion of the support assembly has a slot such as slots 51, 53 in elevated sections 31, 33 respectively. The clip members are designed to wrap around one of the associated edge portions of the raised section of the assembly. For additional stability, the clip members of the end portions wrap about the opposite edge of the raised portion as compared to the edge used by the inner clip members. Thus, the wrap around ends 55, 57 of clip members 45, 47 contain edges 37, 39 of elevated sections 31, 33 respectively. The opposite side of the clip members have formed on their lower surface a detent 59 adapted to fit and lock within the slots of the associated raised section. After the edges of the clip members are positioned about the edges of the associated portion, the detent is snapped into the slot by firmly pressing the clip into mating action with the slot. This action is repeated until each of the four clip members are snapped into position.

The clips also include semicircular depressions on their lower surface to accommodate the pivot pins of their associated pedals. Accordingly, clip member 45 has a circular portion 61 to accommodate the upper part of pivot pin 25. The semicircular areas of the raised portion and associated slot combine to produce a circular opening such as opening 62 associated with clip 71. When snapped in position, a hole in each clip member such as hole 63 in clip 45 is positioned directly over a corresponding opening such as 65 in raised portion 31. The hole in the clip member is counterbored, and screws such as 67, 69 in clip member 71, 73 respectively function to attach the pedal assembly to the piano frame. While the preferred embodiment illustrated is a three pedal assembly, a two pedal assembly would be composed of two end portions and a single intermediate portion.

Figure 2:
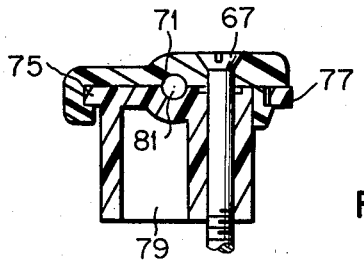
FIG. 2 is a sectional elevation view of the instant invention taken along the lines 2—2 of FIG. 1.

Referring now to FIG. 2, there is illustrated a sectional elevation view of the instant invention taken along the lines 2—2 of FIG. 1 to illustrate the assembly with the clip attached. The front-end of clip 71 is wrapped about the front edge 75 of the support block, while the detent 77 protrudes through the associated slot. The opening for screw 67 is counterbored to provide a flat upper surface after the screw is in position. The support block, as indicated by opening 79, has a hollow interior portion which provides the necessary rigidity and strength without excessive bulk or material. Pivot pin 81, when assembled, is completely encompassed within the support block.

Figure 3:
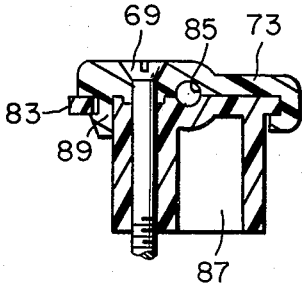
FIG. 3 is a sectional elevation view of the instant invention taken along the lines 3—3 of FIG. 1.

Referring now to FIG. 3, there is illustrated a sectional elevation view of the end portion of the assembly taken along the lines 3—3 of FIG. 1. As previously described, the opposite edge of the upper assembly is secured by the edge clips as compared to the inner clips. Accordingly, the position of clip member 73 is reversed 180° relative to clip 71 whereby the edge of clip 73 is wrapped about the rear of the support block, while the detent 89 extends through the slot in the front of the support block. Pivot pin 85 is positioned within the semicircular portions of the support block and clip, while area 87 indicates the hollow construction of the support assembly.

The piano keys are assembled as above described, and only four screws are required to fasten the assembly to the piano frame. As evident from the above description, the assembly time is extremely nominal and the cost of the plastic support assembly and clip members extremely low such that a truly low cost assembly is provided. It is thus apparent that the instant invention represents a significant advance in the piano pedal assembly art, providing enhanced capability at lower cost.

While the invention has been shown with reference to a preferred embodiment thereof, it will be understood by those skilled in the art that other changes in form and detail may be made therein without departing from the spirit and scope of the invention.

We claim:

1. A piano pedal assembly comprising in combination:

a plurality of pedals, a support member, said support member comprising a unitary base member having a configuration including a plurality of upper surface areas and a plurality of recesses lower surface areas for containing said plurality of pedals, said upper surface areas having extended front and rear edge portions, and means coupling said pedals to said support member in a predetermined orientation, said coupling means including a plurality of clip members, one clip member for each of said upper surface areas, said clip members being adapted to engage said extended front and rear edge portions of said upper surface areas, and each of said clip members including a detent adapted to fit within an associated opening on one of said upper surface areas for securely attaching said clip members to said support member, whereby said pedals are maintained in said predetermined orientation during operation of said foot pedal assembly.

2. A device of the type claimed in claim 1 where said means coupling said pedals to said support member further comprises pin members associated with each of said pedals, said pin members being positioned within openings in said upper surface areas adapted for accommodating said pins.

3. A device of the type claimed in claim 2 wherein said pin members extend through said pedals at their pivot point.

4. A device of the character claimed in claim 2 wherein each of said clip members includes an opening adapted to contain the upper portion of said pin members and retain said pedals in said predetermined orientation.

5. A device of the character claimed in claim 1 wherein said support member is formed as a unitary structure of plastic material.

6. A device of the character claimed in claim 1 wherein said clip members include openings for registration of the pin members associated with said pedals.

* * * * *